US007415786B2

(12) United States Patent
Boydston

(10) Patent No.: US 7,415,786 B2
(45) Date of Patent: Aug. 26, 2008

(54) GREETING AND ANNOUNCEMENT CARDS WITH INTEGRATED PICTURE MAILER AND FRAME

(76) Inventor: Mark W. Boydston, 320 W. Ash St., #207, San Diego, CA (US) 92101

( * ) Notice: Subject to any disclaimer, the term of this patent is extended or adjusted under 35 U.S.C. 154(b) by 339 days.

(21) Appl. No.: 11/115,797

(22) Filed: Apr. 27, 2005

(65) Prior Publication Data

US 2006/0010734 A1 Jan. 19, 2006

Related U.S. Application Data

(60) Provisional application No. 60/571,113, filed on May 14, 2004.

(51) Int. Cl.
*G09F 1/00* (2006.01)

(52) U.S. Cl. ..... 40/124.09; 40/124.17; 40/124.06; 40/777; 40/748; 40/750

(58) Field of Classification Search ..... 40/787, 40/774, 124.06, 124.17, 758, 754, 777
See application file for complete search history.

(56) References Cited

U.S. PATENT DOCUMENTS 333,203 A * 12/1885 Dick ..... 40/124.17
838,880 A * 12/1906 Miner ..... 40/124.06
896,231 A 8/1908 Mulkey
944,385 A * 12/1909 Spiegel ..... 40/445
1,421,097 A * 6/1922 Pente ..... 40/754
2,388,431 A 11/1945 Neiman
2,542,278 A 2/1951 Hueber
2,576,667 A 11/1951 Bly
2,889,646 A * 6/1959 Matthias et al. ..... 40/775
2,958,971 A 11/1960 Plettner
3,174,244 A * 3/1965 Walton ..... 40/774
3,762,630 A 10/1973 Braznell
4,450,638 A * 5/1984 Bader ..... 40/774
4,934,739 A * 6/1990 Stancato ..... 281/38
4,980,982 A 1/1991 Verdon et al.
5,337,949 A * 8/1994 Seeley ..... 229/92.8
6,578,757 B1 * 6/2003 Espenshied et al. ..... 229/92.8
6,612,061 B2 9/2003 Janetzke
6,966,484 B2 * 11/2005 Calonje et al. ..... 229/305

* cited by examiner

*Primary Examiner*—Lesley D. Morris
*Assistant Examiner*—Christopher E Veraa
(74) *Attorney, Agent, or Firm*—Anatoly S. Weiser

(57) ABSTRACT

A greeting or announcement card includes integrated picture mailer and frame. An illustrative embodiment of the card is made by die cutting thick paper stock. The card includes front and back portions disposed side-by-side, and a middle portion disposed under the back portion. Adhesive strips cover the inside of the back portion or of the middle portion. When the card is assembled, it is folded along a line to bring into contact the inside surfaces of the middle and back portions, forming a holding pocket open on one side. A picture can be inserted into the pocket and viewed through an aperture in the middle portion. After insertion, the front portion is folded towards the pocket, and the card is mailed. The card's recipient tears off the front portion, and pulls on a precut tab in the back portion, forming a picture frame with an easel-like stand.

19 Claims, 9 Drawing Sheets

GREETING AND ANNOUNCEMENT CARDS WITH INTEGRATED PICTURE MAILER AND FRAME

REFERENCE TO RELATED APPLICATION

This application claims priority benefit of Provisional U.S. patent application Ser. No. 60/571,113, filed May 14, 2004 which is incorporated herein by reference in its entirety, including tables, figures, and claims.

FIELD OF THE INVENTION

The present invention relates generally to mailable cards, and, more specifically, to mailable greeting and announcement cards with holders capable of carrying and displaying user-insertable items.

BACKGROUND

In this age of instant messaging, email, and almost omnipresent cellular telephones, human need for signs of attention remains unabated. People still like to receive-and send-tangible mementos and signs that someone cares enough to spend a few minutes and a token amount in a gift shop to purchase a card, scribble a few words, and drop it in a mailbox. Many occasions present opportunities for such gestures, including civic and religious holidays, birthdays, anniversaries, graduations, weddings, mother's and father's days, confirmations, bar mitzvas, professional and sport achievements, and a myriad of other events. Quite often, a sender wants to include something extra with the card. Sometimes, it is a check in a money holder. Often, it is a picture.

Many people like to send pictures of themselves or of their loved ones, pictures of events that they have witnessed, or pictures of places that they have visited. With the advent of digital photography and the widespread use of personal computers, a person may be able to take a picture and print it out on the same day. Under fresh impression of an event, the person is likely to want to share the picture with others. Mailing the picture in an envelope accompanied by a greeting or announcement card is an option likely to cross his or her mind.

If the card's recipient wants to display the picture, the recipient would need to buy a picture frame, and mount the picture in the frame. By the time the recipient gets around to doing this, the warm feelings occasioned by the receipt of the picture may subside, or the picture may be lost, folded, soiled, or otherwise made unsuitable for display. Moreover, the recipient may want to display the picture only temporarily, rather than permanently. In this case, the recipient may not want to incur the associated expenditures of money for the frame and effort for the mounting of the picture. On the other hand, the recipient can be quite impatient, and want to display the picture immediately. What grandparent would not want to put a framed picture of a newborn grandchild on the nightstand right away, without waiting?

SUMMARY

A need thus exists for cards and mailers that can be used not only as envelopes for conveying pictures by post, but also for framing the pictures for display after receipt. Another need exists for methods of manufacturing such cards and mailers. Yet another need exists for methods of using such cards and mailers for mailing pictures. Still another need exists for methods of using such cards and mailers to frame pictures for display.

The present invention provides articles of manufacture and methods that satisfy these needs. An exemplary embodiment of the invention herein disclosed is a greeting or announcement card made from a flat body component cut from a flexible material, such as thick paper or cardboard. The flat body component includes a front portion, a back portion attached to the front portion along a first line, and a middle portion attached to the back portion along a third line, each portion having inside and outside surfaces.

The card further includes an adhesive agent placed on the inside surface of the back portion, the inside surface of the middle portion, or on both of these surfaces.

The flat body component is folded along the third line so as to bring the inside surface of the back portion to the inside surface of the middle portion and attach the two surfaces to each other with the adhesive agent, thereby forming a pocket capable of receiving a picture. The picture can be viewed through an aperture that is present within the middle portion. The adhesive agent is placed so that the pocket is open along at least one side, allowing the picture to be inserted into the pocket.

The back portion has a weakened segment along a second line. "Weakened" in this context includes perforation, scoring, or similar structural weaknesses intended to make it easier to tear along the weakened segment. "Weakening" also encompasses cutting through the portion. The weakened segment defines a tab that can be pulled away from the back portion to form an easel stand for the card.

In use, a consumer purchases the card, inscribes it, and places a picture into the pocket of the card. The consumer than mails the card with the picture to a recipient. The recipient opens the card and tears off the front portion along the first line. The recipient then pulls the tab to tear along the weakened segment. The picture framed in the card can then be set on a surface using the tab as an easel stand, and displayed.

These and other features and aspects of the present invention will be better understood with reference to the following description, drawings, and appended claims.

DETAILED DESCRIPTION

Figure 1:
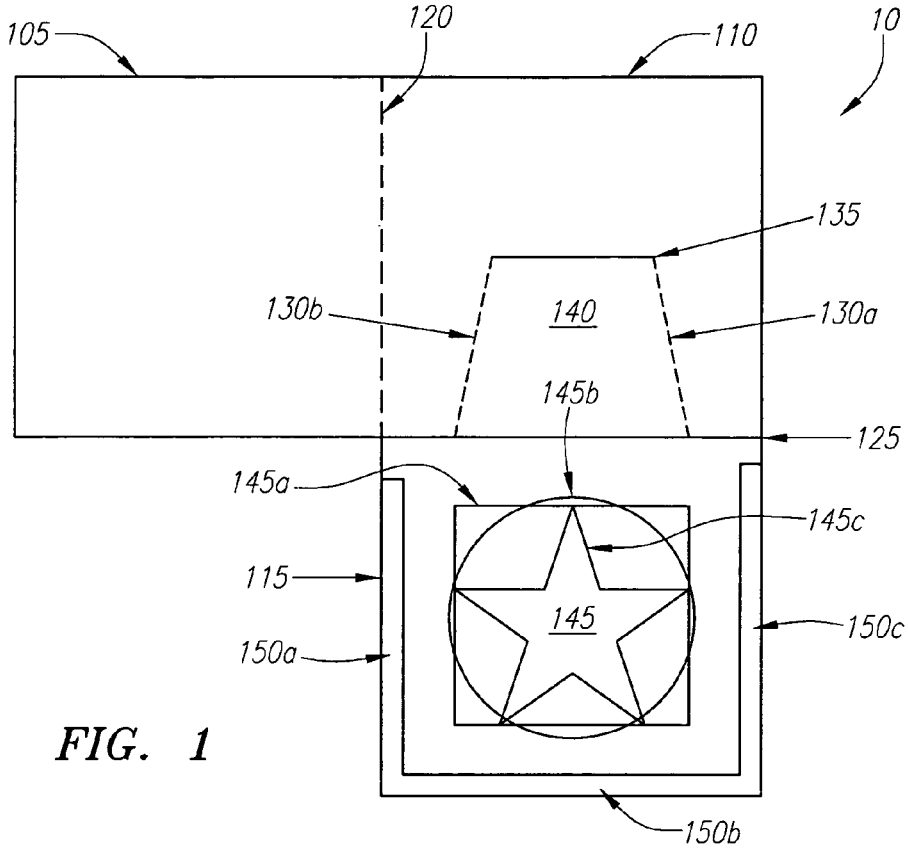
FIG. 1 illustrates an inside cover of an unassembled card with an integrated picture mailer and picture frame, in accordance with an embodiment of the present invention.

Reference will now be made in detail to several embodiments of the invention that are illustrated in the accompanying drawings. Wherever possible, same or similar reference numerals are used in the drawings and the description to refer to the same or like parts and steps. The drawings are in simplified form and not to precise scale. For purposes of convenience and clarity only, directional terms, such as top, bottom, left, right, up, down, over, above, below, and beneath may be used with respect to the accompanying drawings. These and similar directional terms should not be construed to limit the scope of the invention in any manner.

In this description and in the appended claims, the word "card" refers to greeting cards, post cards, announcement cards, promotional cards, and similar printed materials, whether or not they are designed to receive personalized hand-written inscriptions. Such cards can but need not be expressly designed for mailing. The word "mailer" is used to refer to a card in combination with an envelope, or a card otherwise designed for conveyance by post. "Print," "imprint," and similar words with their inflectional morphemes refer to production or reproduction of characters, symbols, designs, or any other images, for example, by offset printing, inkjet printing, and laser printing.

Figure 2:
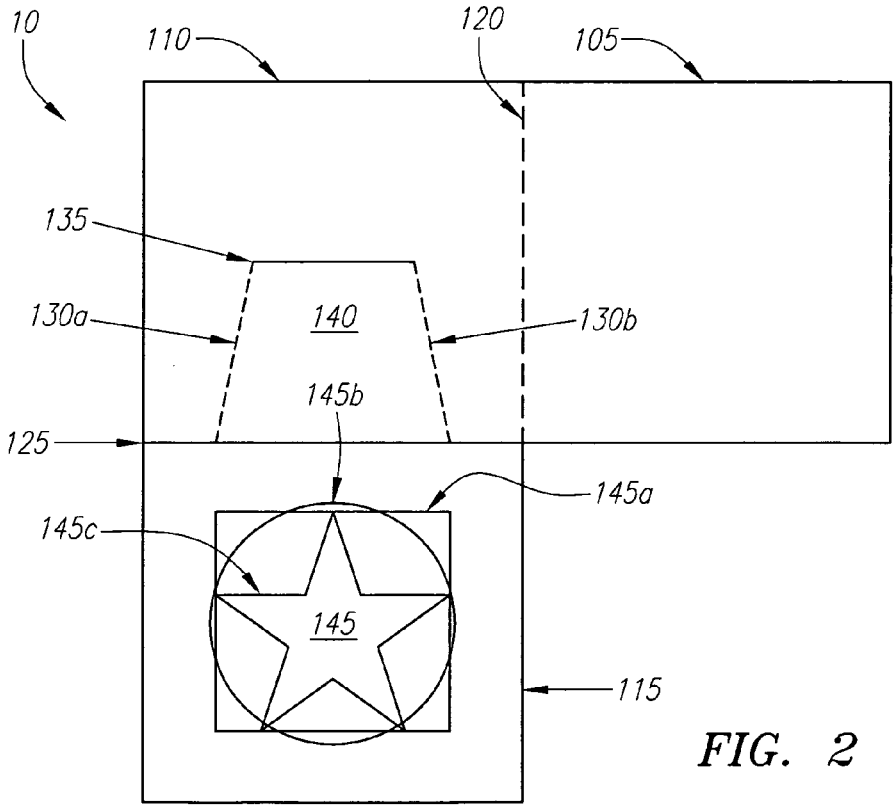
FIG. 2 illustrates an outside cover of the unassembled card of FIG. 1.

Referring more particularly to the drawings, FIGS. 1 and 2 illustrate, respectively, inside and outside cover surfaces of an unassembled card 10 in accordance with an embodiment of the present invention. In the illustrated embodiment, the card 10 is made from cover stock paper of weight between about 90 and 120 lbs. In other embodiments, the card 10 is made from paper of different weights, from cardboard, and from various other fiber materials, both woven and non-woven. A combination of materials may also be used. In general, the choice of a specific material or combination of materials for the card 10 may be determined by weighing several sometimes competing considerations, including these:

1. Material cost;
2. Cost of processing, e.g., cutting to size, imprinting, perforating, scoring;
3. Durability;
4. Flexibility and rigidity;
5. Appearance;
6. Tactility;
7. Weight per unit area;
8. Ability to be recycled; and
9. Source of the material, e.g., recycled or not recycled.

The above list of consideration is, of course, not exclusive.

As shown in FIGS. 1 and 2, the card 10 includes the following major components: a front portion 105, a back portion 110, and a picture holding middle portion 115. Each of the portions 105, 110, and 115 may be imprinted on its inside cover surface, outside cover surface, or on both of these surfaces. Any of the surfaces may also be left blank.

Figure 3:
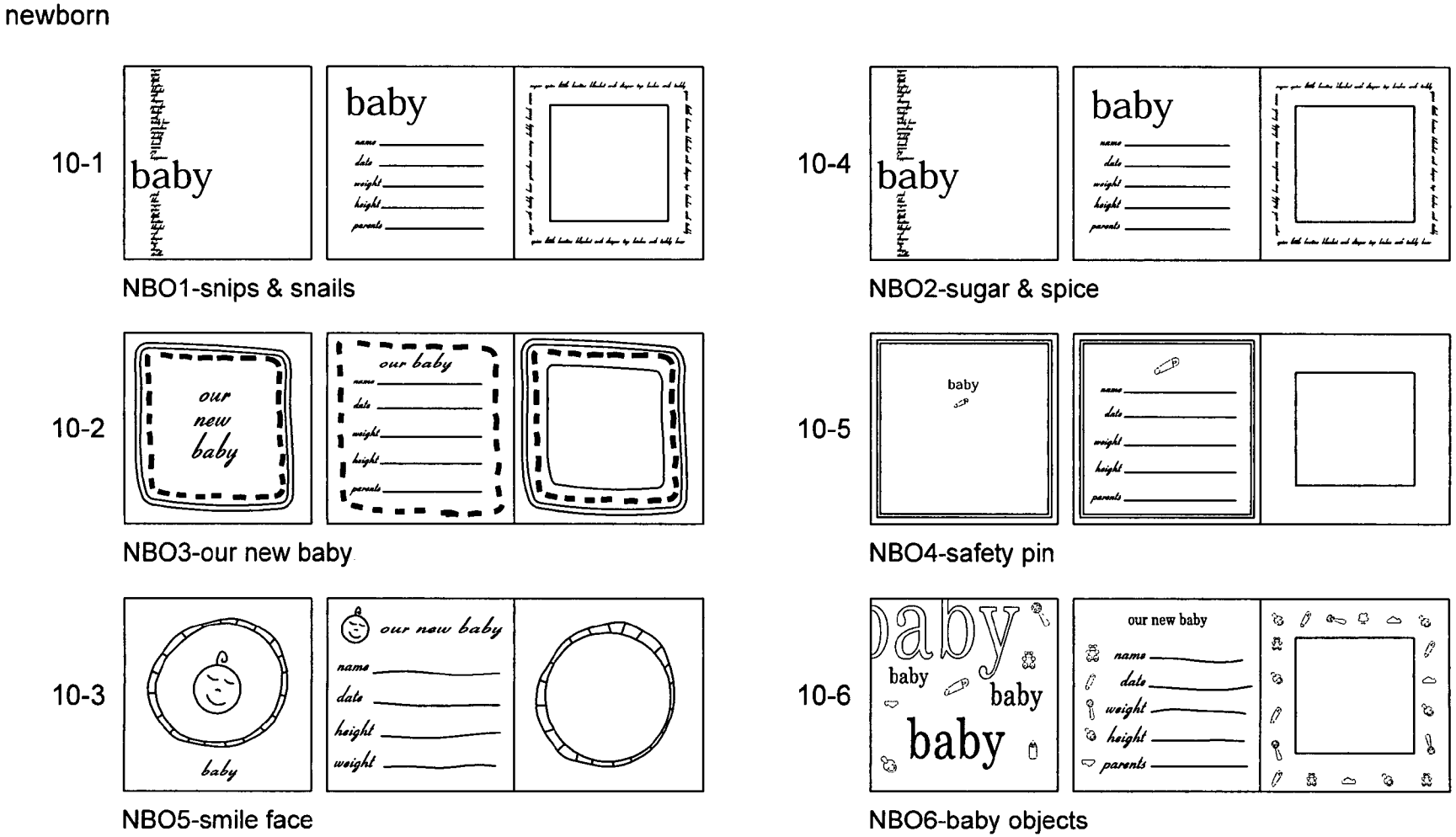
FIGS. 3, 4, and 5 illustrate various printing schemes for cards in accordance with embodiments of the present invention.
Figure 4:
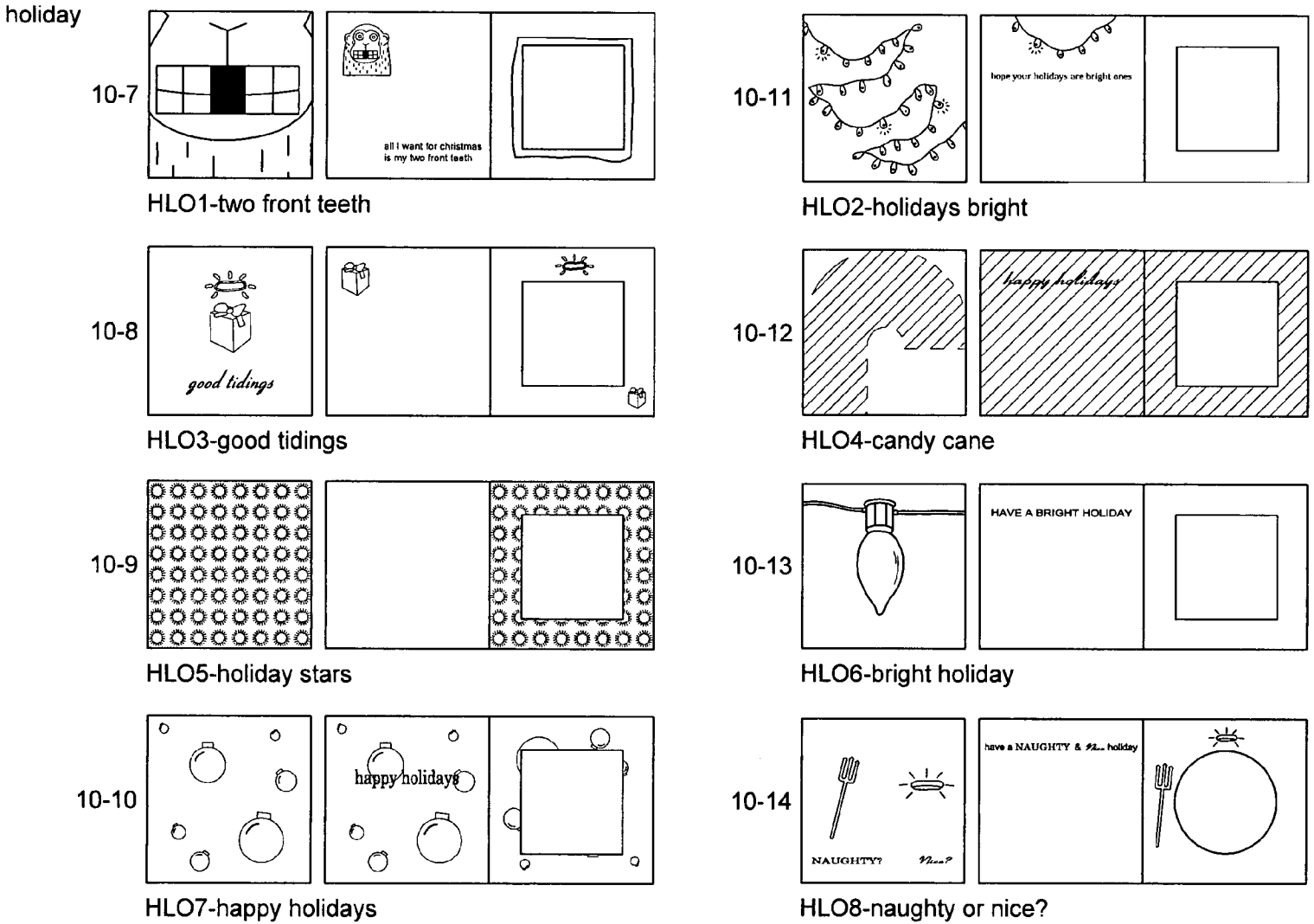
Figure 5:
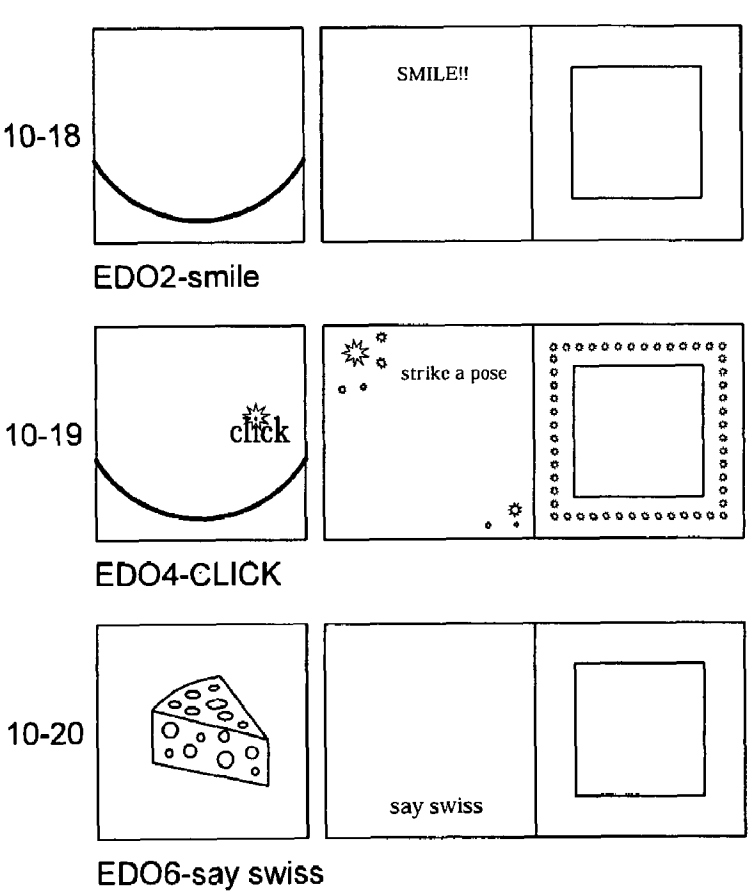
Figure 5:
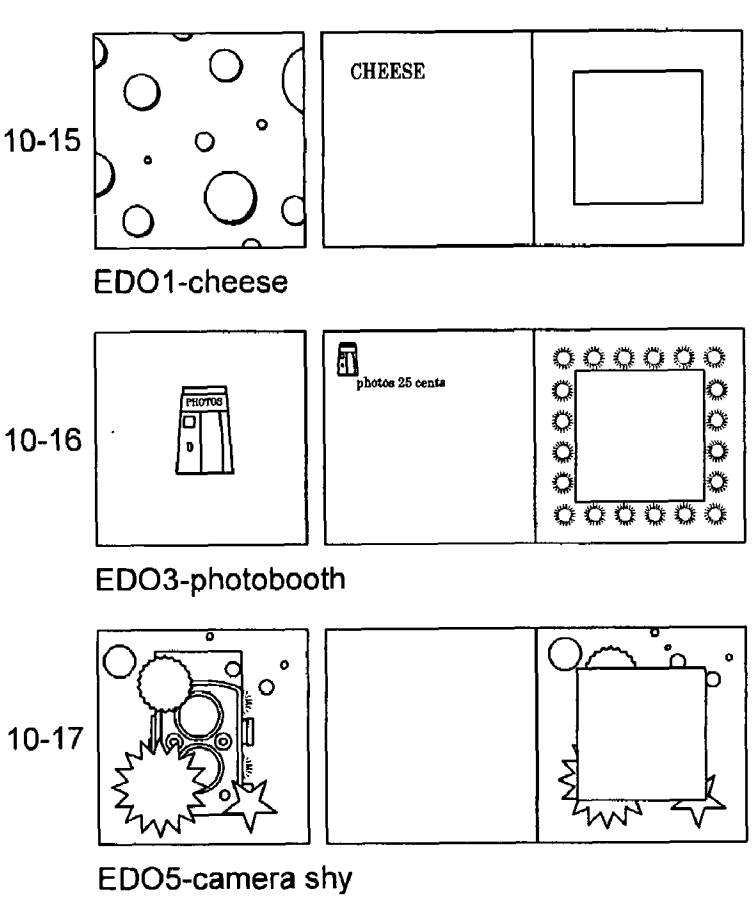

Various printing schemes are illustrated in FIGS. 3, 4, and 5, for variants 10-1 through 10-20 of the basic card 10. Note that only printed portions of each card variant 10-1 through 10-20 are illustrated in these Figures. The leftmost square of each card variant 10-1 through 10-20 shows the pattern printed on the outside surface of the portion 105, the center square shows the pattern on the inside surface of the portion 105, and the rightmost square shows the pattern on the outside surface of the portion 115. The outside surface of the portion 110 may also be imprinted, for example, with an SBN number, copyright sign, manufacturer and ordering information, suggested retail price, and bar code.

In some embodiments in accordance with the present invention, the inside surface of the portion 105 is imprinted so as to display an area for a personalized hand-written message or even for a short letter. For example, one or more straight or wavy lines may be printed in this area to facilitate handwriting. Additional printing options for the outside surface of the portion 105 will be discussed further below.

Note that the inside surfaces of the portions 110 and 115 may also be imprinted, but this is rarely needed because, as will become apparent from the description of the process of assembling the card 10, these areas are generally not seen by the retail consumer.

As can be seen from at least some printing schemes illustrated in FIGS. 3-5, peripheral area of the outside cover of the portion 115 may be advantageously imprinted with a pattern resembling or otherwise evoking an image of borders of a wooden picture frame.

The portions 105, 110, and 115 of the unassembled card 10 are cut as a single piece from preprinted paper using, for example, a die cutting process. In alternative embodiments, other cutting processes may be used. In alternative embodiments, the portions 105, 110, and 115 may be printed upon after the portions are cut from the paper. Lines designated with reference numerals 120 and 125 separate the three portions from each other.

To facilitate bending and folding along the lines 120 and 125 when assembling the card 10, these lines are scored in the paper of the unassembled card 10. Scoring may be performed, for example, by making impressions with a bone folder. In alternative embodiments, other scoring instruments may be used, such as automatic scoring machines. In still other alternative embodiments, the card 10 is not pre-scored, but is simply machine-bent along the lines 120 and 125 during the assembly process.

In some embodiments in accordance with the invention, the line 120 is perforated, to enable the recipient of the card 10 easily to tear the portion 105 from the portions 110 and 115. The consumer may then discard the torn-off portion 105.

Lines 130*a*, 130*b*, and 135 on the back portion 110 define an easel stand tab 140. In the illustrated embodiment, the lines 130 are precut; this may be done at the same time as die cutting the portions 105, 110, and 115 of the card. The line 135 may be scored. In this way, the tab 140 may be pulled away from the back portion 110 along the lines 130, bending along the line 135. In alternative embodiments, the lines 130 are perforated, also enabling relatively easy separation along the lines 130 and bending or folding along the line 135. More generally, the back portion is weakened along the lines 130 to facilitate tearing along these lines. As will be seen further below, the tab 140 forms an easel stand for displaying a picture by the recipient of the card 10.

An aperture 145 is formed in the middle portion 115. FIGS. 1 and 2 show alternative shapes for this aperture, including a square, a circle, and a star. These alternative shapes are designated with reference numerals 145*a*, 145*b*, and 145*c*, respectively. The aperture is used for viewing the picture inserted into the card 10. A person skilled in the pertinent art would understand that there are great many other aperture shapes that may be used for this purpose. For example, oval aperture shapes are often chosen by users of picture frame. The aperture may also be covered by a sheet of transparent material, for example, plastic or cellophane.

Reference numerals 150*a*, 150*b*, and 150*c* designate adhesive strips on the inside surface of the picture holding middle portion 115. The strips are formed by applying glue to these areas. In some alternative embodiments, the strips are formed by applying double-sided adhesive strips to the peripheral inside areas of the portion 115. The adhesive strips 150 need not be continuous; instead, one or more discrete adhesive spots may be applied to the peripheral areas.

During the process of assembling the card 10, the unassembled card 10 is folded or bent along the line 125. The adhesive strips (or spots) 150 then attach the inside cover surface of the portion 115 to the inside cover surface of the portion 110. A pocket is thus formed between the portions 110 and 115. The pocket is closed on three sides, and has an opening along its forth side. In the illustrated embodiment, the opening is formed along the "top" side, but this is not necessarily a requirement of the invention. In alternative embodiments, the opening may be formed along right or left sides, or even along the bottom side. The pocket is used to hold a photograph or other picture, which is inserted from the open side.

Note that adhesive strips may be placed on the inside cover of the back portion 110, either in addition to, or instead of the adhesive strips 150.

The card 10 may advantageously include some means for preventing the picture from accidentally sliding out of the pocket, particularly if the opening for inserting the picture is formed along the bottom side. For example, an adhesive area may be included on the inside surface of the portion 110. The adhesive area may be covered by a protective peel-off strip, which may be removed by the user after insertion of the picture, to secure the picture within the pocket.

In other embodiments, the pocket is sufficiently tight to hold the picture without any additional means for preventing the picture from sliding out. One advantage of this embodiment is that the picture can be more easily replaced by another picture.

Figure 6:
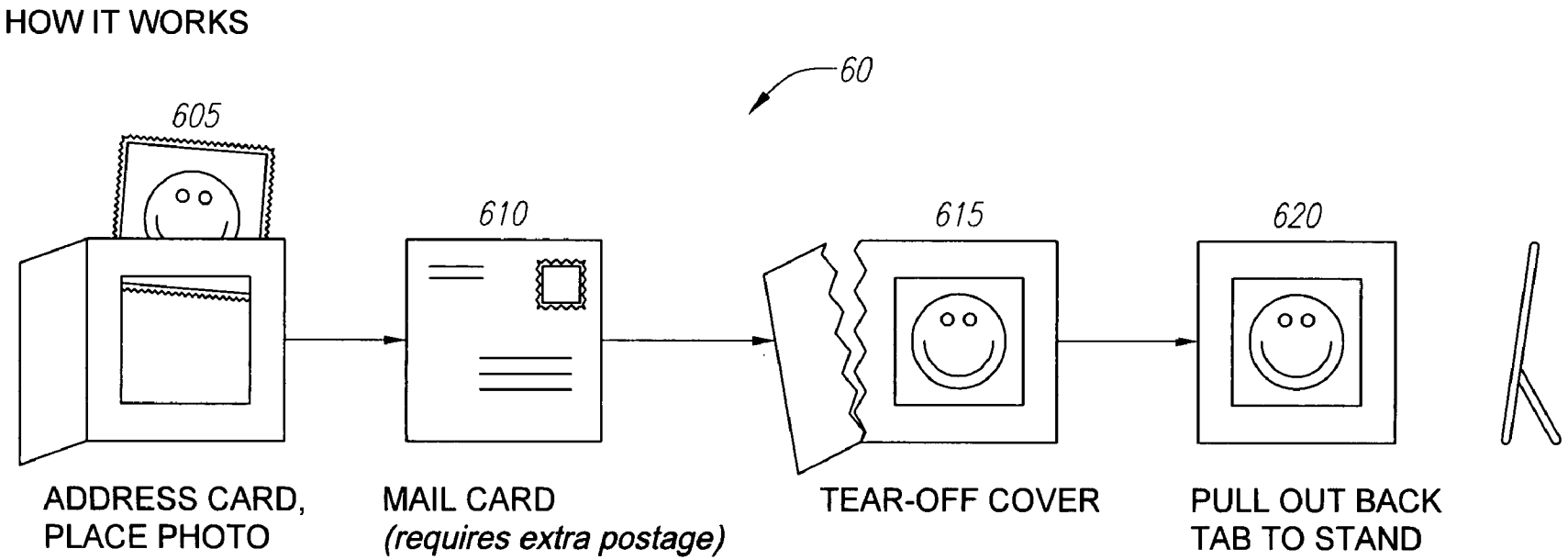
FIG. 6 illustrates selected steps of a process of using a card with an integrated mailer and frame, in accordance with an embodiment of the present invention.

FIG. 6 illustrates selected steps of a process 60 of using the card 10. At step 605, the card 10 is inscribed and a picture is placed in the pocket between the back potion 110 and the picture holding middle portion 115.

At step 610, the card is mailed. This step may include folding the card along the line 120 and putting the folded card in an addressed and stamped envelope. Alternatively, the outside surface of the front portion 105 may be imprinted as an envelope face. In this case, the outside surface of the front portion 105 may be inscribed with appropriate address(es) and stamped. In some embodiments, the outside surface of the front portion 105 is preprinted with a postage stamp.

At step 615, the addressee receives the card 10, reads the inscription on the inside of the front portion 105, and tears off the front portion 105 from the picture holding pocket formed by the portions 110 and 115.

At step 620, the recipient-addressee pulls on the tab 140, punching out the perforation along the lines 130 in the process, and bends the tab 140 away from the rest of the back portion 110. A picture frame with and easel stand is thus formed. The recipient can then place the picture frame on a surface for display.

Referring again to FIGS. 1 and 2, the front and back portions 105 and 110 of the card 10 are disposed side-by-side, with the middle portion 115 being disposed below the back portion 110. Other arrangements of the respective portions are also possible. For example, the middle portion 115 may be disposed above the back portion 110. The three portions may also be disposed in a straight line, either horizontally or vertically. In addition, the tab 140 on the back portion 110 may be modified to allow hanging of the picture frame resulting from the card 10.

Figure 7:
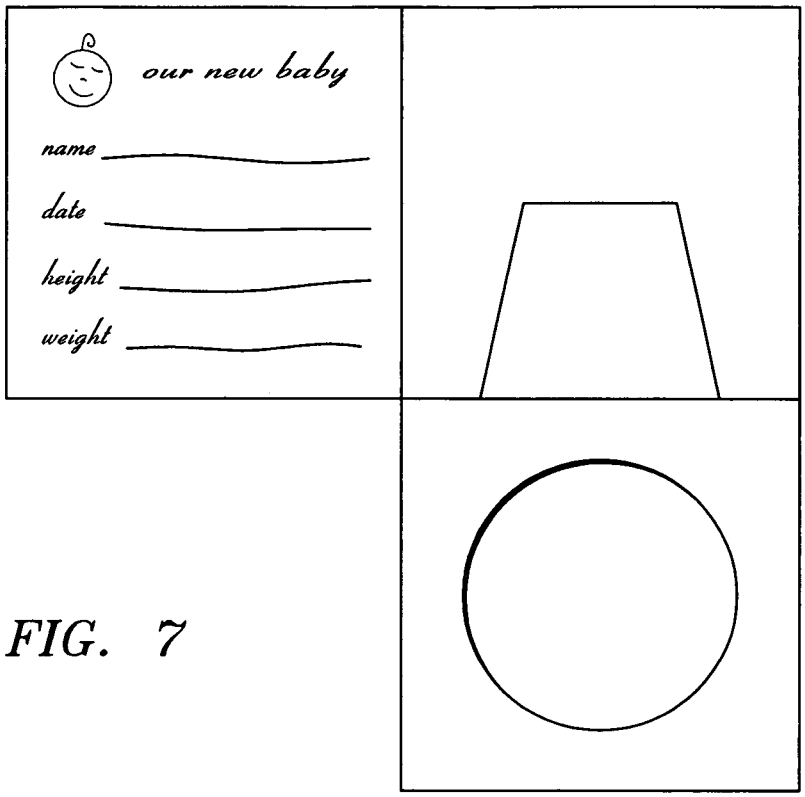
FIG. 7 illustrates an imprinted inside cover of an unassembled card, in accordance with an embodiment of the present invention.
Figure 8:
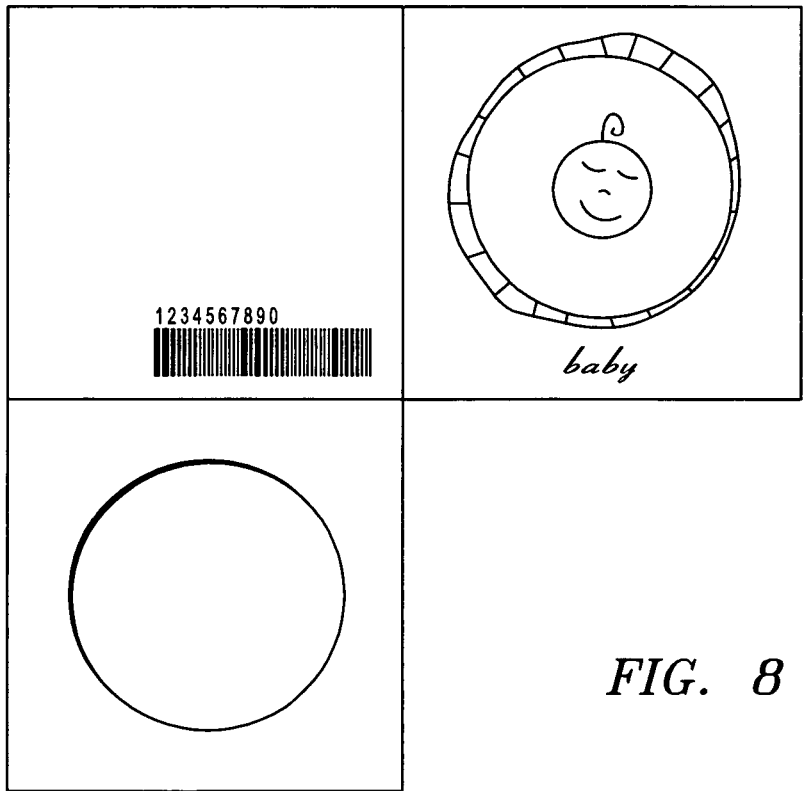
FIG. 8 illustrates an outside cover of the unassembled card of FIG. 7.
Figure 9:
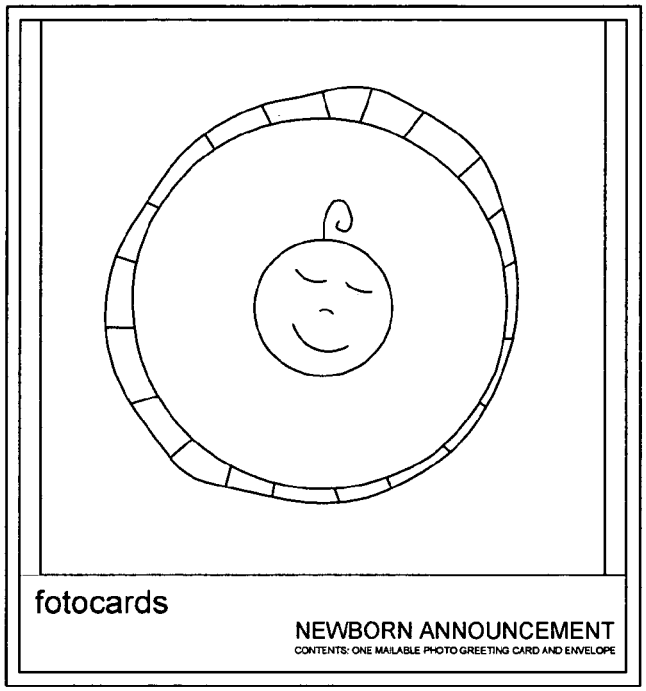
FIG. 9 illustrates the card of FIGS. 7 and 8 packaged together with an envelope for mailing the card, in accordance with an embodiment of the present invention.
Figure 10:
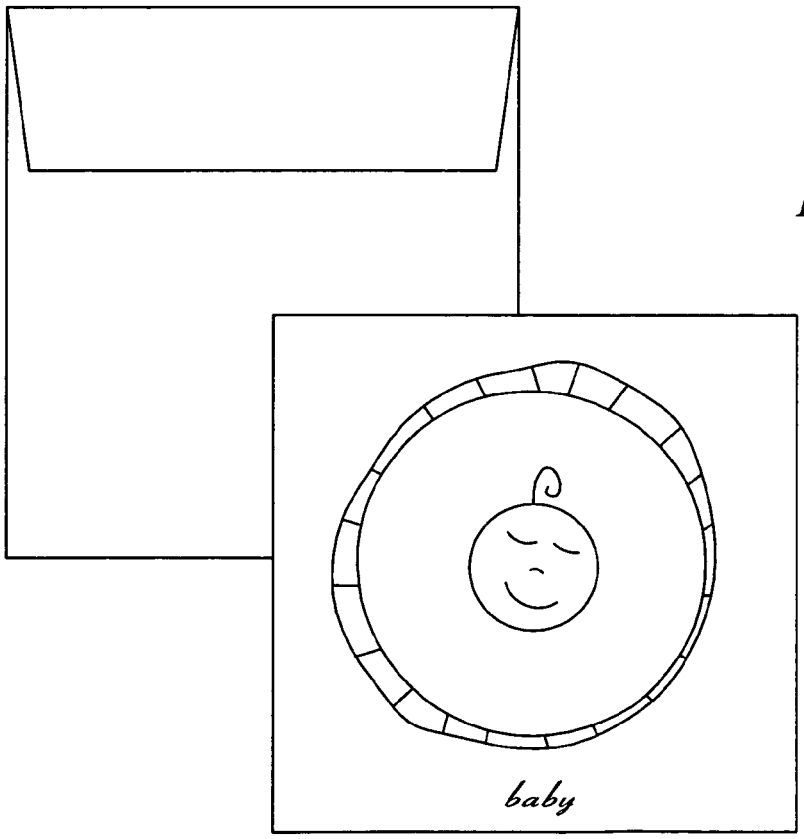
FIG. 10 illustrates an unwrapped card and envelope of the embodiments of FIGS. 6-9.
Figure 11:
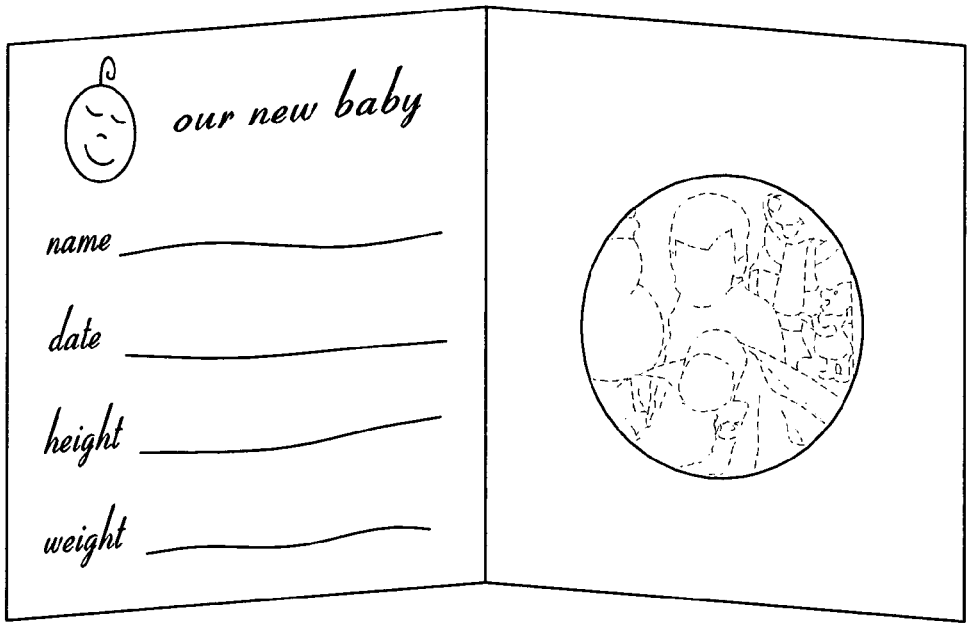
FIG. 11 illustrates an assembled card of the embodiments of FIGS. 6-10 with a picture inserted into the pocket formed in the card.
Figure 12:
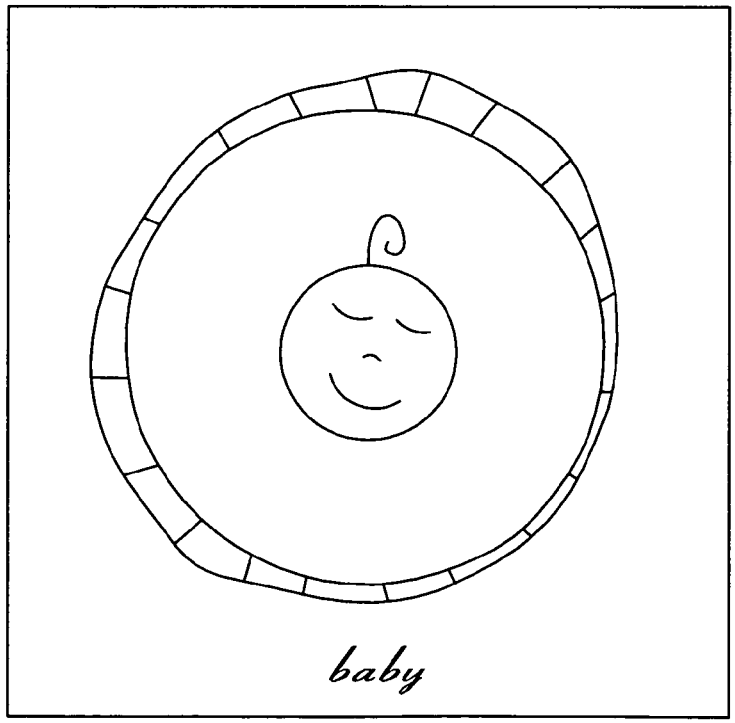
FIG. 12 illustrates the card of the embodiments of FIGS. 6-11 folded and ready for inserting into its envelope, for subsequent mailing.
Figure 13:
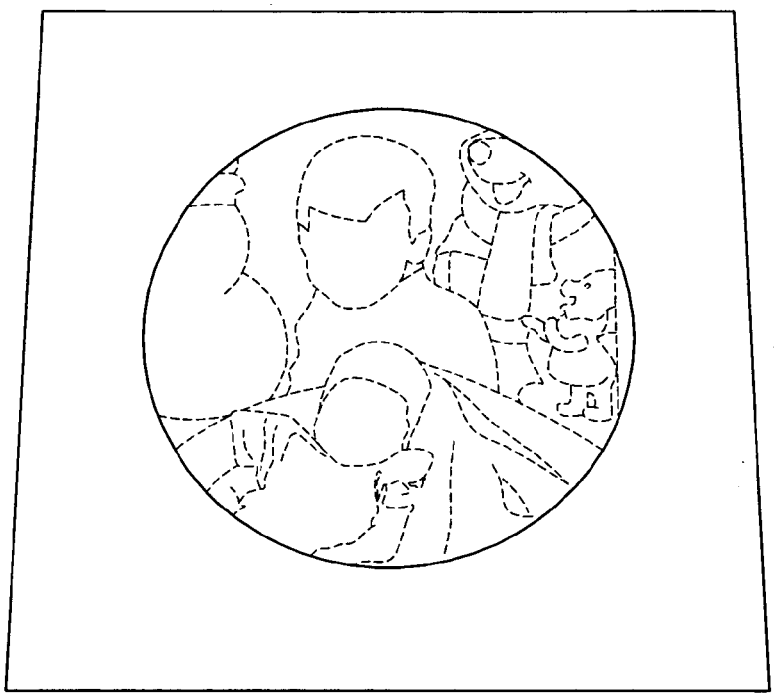
FIG. 13 illustrates a picture frame formed from the card of the embodiments of FIGS. 6-12.
Figure 14:
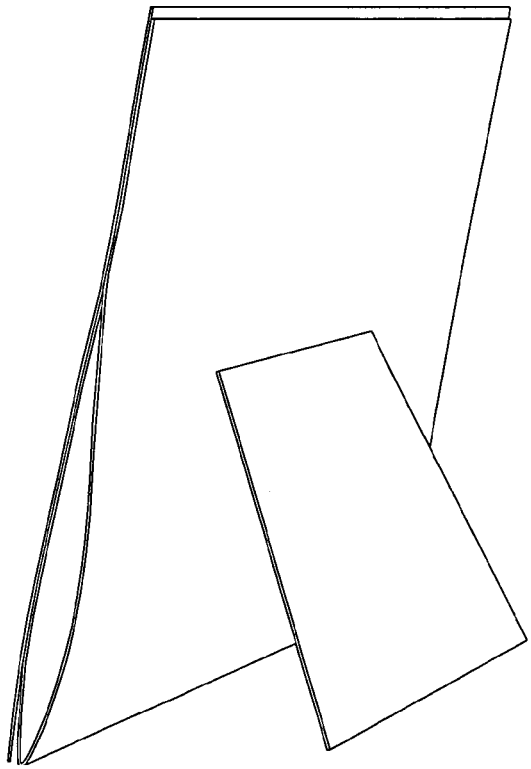
FIG. 14 illustrates the picture frame of FIG. 13 with a rear tab punched off and pulled away to form an easel stand for the frame.

FIGS. 7-14 illustrate various aspects of a particular variant of the card 10 in accordance with the present invention. FIGS. 7 and 8 illustrate inside and outside cover surfaces of the unassembled card 10, respectively, with imprinting that makes the card 10 suitable for announcing birth of a child. FIG. 9 illustrates the card 10 packaged together with an envelope for mailing the card. FIG. 10 illustrates the card 10 and its envelope removed from the package wrapper. FIG. 11 illustrates assembled card 10 with a picture inserted into the pocket of the card. FIG. 12 illustrates the card 10 folded and ready for inserting into the envelope for subsequent mailing. FIG. 13 illustrates the picture frame formed from the card 10 after the card is received and the front portion 105 is torn off. FIG. 14 illustrates the frame with the tab 140 pulled away from the back portion 110, thereby forming an easel stand.

This document describes cards with integrated display frames in considerable detail. This was done for illustration purposes only. Neither the specific embodiments of the invention as a whole, nor those of its features, limit the general principles underlying the invention. In particular, the invention is not limited to the specific materials used for manufacturing the cards, the specific configurations of the various card portions, the specific printing techniques, or the specific picture-viewing aperture shapes. The particular features described herein may be used in some embodiments, but not in others, without departure from the spirit and scope of the invention as set forth. Many additional modifications are intended in the foregoing disclosure, and it will be appreciated by those of ordinary skill in the pertinent art that in some instances some features of the invention will be employed in the absence of a corresponding use of other features. The illustrative examples therefore do not define the metes and bounds of the invention and the legal protection afforded the invention, which function is carried out by the claims and their equivalents.

I claim:

1. A card comprising:

a flat body cut from a flexible material, the flat body comprising:

a front portion comprising an inside surface and an outside surface, a back portion comprising an inside surface and an outside surface, the back portion being attached to the front portion along a first line, the back portion comprising a weakened segment along a second line, and a middle portion comprising an inside surface and an outside surface, the middle portion being attached to the back portion along a third line, the middle portion comprising sections defining an aperture; and an adhesive agent placed on at least one surface selected from the group consisting of the inside surface of the back portion and the inside surface of the middle portion;

wherein:

the flat body is folded along the third line so as to bring the inside surface of the back portion to the inside surface of the middle portion and attach the inside surface of the back portion to the inside surface of the middle portion with the adhesive agent to form a pocket capable of receiving a picture that can be viewed through the aperture;

the adhesive agent is placed so that the pocket is open along at least one side; and the weakened segment defines a tab that can be pulled away from the back portion to form an easel stand for the card.

2. A card according to claim 1, wherein the flat body is perforated along the first line to facilitate separation of the front portion from the pocket.

3. A card according to claim 2, wherein the outside surface of the front portion is imprinted to appear as a greeting card.

4. A card according to claim 2, wherein the outside surface of the front portion is imprinted to appear as an announcement card.

5. A card according to claim 2, wherein the outside surface of the front portion is imprinted to appear as an envelope face.

6. A card according to claim 2, wherein the outside surface of the front portion is imprinted.

7. A card according to claim 6, wherein the inside surface of the front portion is imprinted.

8. A card according to claim 6, wherein the inside surface of the front portion is imprinted so as to display an area for a hand-written message.

9. A card according to claim 6, further comprising means for preventing the picture from accidentally sliding out of the pocket.

10. A card according to claim 6, wherein the outside surface of the middle portion is preprinted so as to evoke an image of a wooden picture frame border.

11. A method of making a card, the method comprising:

cutting a flat body from a flexible material, the flat body comprising (i) a front portion comprising an inside surface and an outside surface, (ii) a back portion comprising an inside surface and an outside surface, the back portion being attached to the front portion along a first line, and (iii) a middle portion comprising an inside surface and an outside surface, the middle portion being attached to the back portion along a third line, the middle portion comprising sections defining an aperture;

creating a weakened segment on the back portion along a second line;

applying an adhesive agent on at least one surface selected from the group consisting of the inside surface of the back portion and the inside surface of the middle portion;

folding the flat body along the third line so as to bring the inside surface of the back portion to the inside surface of the middle portion and attach the inside surface of the back portion to the inside surface of the middle portion with the adhesive agent to form a pocket capable of receiving a picture that can be viewed through the aperture;

wherein:

the adhesive agent is placed so that the pocket is open along at least one side; and the weakened segment defines a tab that can be pulled away from the back portion to form an easel stand for the folded flat body.

12. A method according to claim 11, further comprising perforating the flat body along the first line to facilitate separation of the front portion from the pocket.

13. A method according to claim 12, further comprising printing on the outside surface of the front portion to make the outside surface of the front portion appear as a greeting card.

14. A method according to claim 12, further comprising printing on the outside surface of the front portion to make the outside surface of the front portion appear as an announcement card.

15. A method according to claim 12, further comprising printing on the outside surface of the front portion to make the outside surface of the front portion appear as an envelope face.

16. A method according to claim 12, further comprising printing on the outside surface of the front portion.

17. A method according to claim 16, further comprising printing on the inside surface of the front portion.

18. A method according to claim 16, further comprising printing on the inside surface of the front portion to create an area for a hand-written message on the inside surface of the front portion.

19. A method according to claim 16, further comprising step for preventing the picture from accidentally sliding out of the pocket.

* * * * *